US009232863B1

(12) United States Patent
Zenoff

(10) Patent No.: US 9,232,863 B1
(45) Date of Patent: Jan. 12, 2016

(54) SUPPORT STRUCTURE

(71) Applicant: Andrew R. Zenoff, San Francisco, CA (US)

(72) Inventor: Andrew R. Zenoff, San Francisco, CA (US)

(73) Assignee: ZENOFF PRODUCTS, INC., San Anselmo, CA (US)

( * ) Notice: Subject to any disclaimer, the term of this patent is extended or adjusted under 35 U.S.C. 154(b) by 0 days.

(21) Appl. No.: 14/089,628

(22) Filed: Nov. 25, 2013

Related U.S. Application Data

(63) Continuation of application No. 12/930,851, filed on Jan. 19, 2011, now Pat. No. 8,590,078.

(51) Int. Cl.
*A47D 13/08* (2006.01)

(52) U.S. Cl.
CPC ..... *A47D 13/083* (2013.01); *A47D 13/08* (2013.01)

(58) Field of Classification Search
CPC ..... A47D 13/083; A47D 13/08
USPC ..... 5/652, 655, 657
See application file for complete search history.

(56) References Cited

U.S. PATENT DOCUMENTS 5,581,833 A * 12/1996 Zenoff ..... 5/655
5,664,828 A 9/1997 Simon
5,790,999 A 8/1998 Clark
6,434,770 B2 8/2002 Matthews
6,484,337 B1 11/2002 Moe et al.
6,685,024 B1 2/2004 Matthews
7,010,821 B1 3/2006 Leach
7,055,196 B2 6/2006 Littlehorn
7,127,760 B2 10/2006 Bartley et al.
7,290,303 B2 11/2007 Mead et al.
7,454,808 B2 11/2008 Parrilla
7,587,773 B2 9/2009 Littlehorn et al.
8,166,587 B2 5/2012 Collins
8,418,295 B2 4/2013 Clark
8,590,078 B1 * 11/2013 Zenoff ..... 5/655
2006/0265809 A1 11/2006 Wagner
2007/0056110 A1 3/2007 Tuoriniemi et al.
2011/0119833 A1 * 5/2011 Clark ..... 5/655

OTHER PUBLICATIONS

Regarding related patents and patent applications, see the section of the accompanying IDS letter entitled "Related Patents and Patent Applications" for further information.

* cited by examiner

*Primary Examiner* — Michael Trettel
(74) *Attorney, Agent, or Firm* — Siritzky Law, PLLC

(57) ABSTRACT

Support structures which can be placed around the waist of a user, for example a mother nursing twins. A front member and a rear member cooperate to provide an openable enclosure which can first be placed around, and then closed around, the waist of the user. The front member provides a platform which is in front of the user and on which are placed one or more babies, or other items desired by the user. The platform has desired characteristics, for example a first surface which is horizontal and a second surface which is inclined towards the user.

21 Claims, 6 Drawing Sheets

SUPPORT STRUCTURE

This application is a Continuation Application of U.S. patent application Ser. No. 12/930,851 filed on Jan. 19, 2011, now U.S. Pat. No. 8,590,078.

FIELD OF THE INVENTION

This invention relates to support structures, particularly support structures for nursing mothers and their babies.

BACKGROUND OF THE INVENTION

A number of support structures for nursing mothers and their babies are known. Reference may be made, for example, to U.S. Pat. No. 6,434,770 (Matthews), U.S. Pat. No. 6,685,024 (Matthews), U.S. Pat. No. 7,055,196 (Littlehorn), U.S. Pat. No. 7,127,760 (Bartley), U.S. Pat. No. 7,290,303 (Mead), U.S. Pat. No. 7,587,773 (Littlehorn), U.S. Pat. No. 5,664,828 (Simon), U.S. Pat. No. 5,790,999 (Clark), U.S. Pat. No. 7,010,821 (Leach), U.S. Pat. No. 5,581,833 (Zenoff), and US 2007/0056110 (Tuoriniemi). The entire disclosure of each of those US patents and patent publication is incorporated herein by reference for all purposes.

SUMMARY OF THE INVENTION

I have discovered, in accordance with the present invention, a novel support structure. The novel support structure is particularly, but not exclusively, useful for mothers who are nursing twin babies simultaneously, and the invention will be described chiefly by reference to such use. However, the invention is not limited to such use, because the support structure can be used for other purposes, for example, to assist a mother who is feeding a single baby, or any person who is feeding one or more babies, or to help in accomplishing any task which requires working with the hands in proximity to the lap, e.g. operating a laptop computer or other handheld device, sewing, knitting, typing, reading or writing. The support structure is described herein as it is to be used by an adult, but reduced sized versions of the support structure will be appropriate for children, including very young children who can use the support structure in imitation of adults.

In a first aspect, this invention provides a support structure which can be placed around the waist of a user and which comprises (1) a front member which has an outer perimeter and an inner perimeter, and (2) a rear member which is secured to the front member, and which can be moved between (i) a first position in which the rear member and the inner perimeter of the front member define between them an open area having an opening through which the waist of a user can pass, and (ii) a second position in which the rear member extends across the opening and forms an enclosure around the waist of a user;

the front member having an upper surface which has at least one of the following features:—

(A) it comprises (a) a first area which extends across the front of a user and (b) a second area which (i) extends across the front of a user, (ii) is closer to the inner perimeter than the first area, and (iii) is inclined downwards relative to the is first area; and (B) it includes at least one upstanding ridge, the upstanding ridge being adjacent to at least part of the inner perimeter or the outer perimeter of the front member.

In a second aspect, this invention provides a support structure which comprises (1) a front member which (a) has substantial width and substantial thickness, (b) has substantial firmness, (c) comprises a lower surface, an upper surface, an outer wall surface which extends from the upper surface to the lower surface and which provides an outer surface, an inner wall surface which extends from the upper surface to the lower surface and which provides an inner surface, and two end wall surfaces each of which extends from the upper surface to the lower surface at an end of the front member; and (2) a rear member which comprises.

(a) a central member which has substantial firmness, and (b) first and second arms which extend from either side of the central member, and which, when placed with the arms adjacent to the end wall surfaces of the front member, form an enclosure which (i) comprises the central member and the inner wall surface of the front member, and (ii) will fit around the waist of a user of the support structure;

the front member having an upper surface which has at least one of the following features:—

(A) it comprises (a) a first area which extends across the front of the member and (b) a second area which (i) extends across the front of a the member (ii) is is closer to the inner wall surface than the first area, and (iii) is inclined downwards relative to the first area; and (B) it includes at least one upstanding ridge, the upstanding ridge being adjacent to at least part of the inner perimeter or the outer perimeter of the front member.

In a third aspect, this invention provides a support structure which comprises (1) a front member which (a) has substantial width and substantial thickness, (b) has substantial firmness.

(c) comprises a lower surface, an upper surface, an outer wall surface which extends from the upper surface to the lower surface and which provides an outer surface, an inner wall surface which extends from the upper surface to the lower surface and which provides an inner surface, and two end wall surfaces each of which extends from the upper surface to the lower surface; and (2) a rear member which comprises.

(a) a central member, and (b) first and second arms which extend from either side of the central member, and which, when placed with the arms adjacent to the end wall surfaces of the front member, form an enclosure which (i) comprises the central member and the inner wall surface of the front member, and (ii) will fit around the waist of a user of the support structure;

the front member having an upper surface which has at least one of the following features:—

(A) it comprises (a) a first area which extends across the front of the member and (b) a second area which (i) extends across the front of a the member, (ii) is closer to the inner wall surface than the first area, and (iii) is inclined downwards relative to the first area; and (B) it includes at least one upstanding ridge, the upstanding ridge being adjacent to at least part of the inner perimeter or the outer perimeter of the front member.

In a fourth aspect, this invention provides a support structure which can be placed around the waist of a user and which comprises (1) a front member which has an outer perimeter, an inner perimeter, an upper surface and a lower surface, and (2) a rear member which is secured to the front member, and which can be moved between (i) a first position in which the rear member and the inner perimeter of the front member define between them an open area having an opening through which the waist of a user can pass, and (ii) a second position in which the rear member extends across the opening and forms an enclosure around the waist of a user;

the lower surface being shaped so that, when the front and rear members form the enclosure and the enclosure fits around the waist of a user who is sitting down with the lower surface of the front member resting on the user's thighs or knees, the top surface of the front member comprises an area which is inclined downwards.

In a fifth aspect, this invention provides a support structure which can be placed around the waist of a user and which comprises (1) a front member which has an outer perimeter and an inner perimeter, and an upper operational surface between the outer perimeter and in the perimeter, the upper operational surface preferably comprising an area which extends across the front of the member and is inclined downwards, and optionally an additional second area which is substantially horizontal; and (2) a rear member which can be secured to the front member to define, between the rear member and the inner perimeter of the front member him an open area having an opening through which the waist of a user can pass, the support structure being such that, when it is secured in place around the waist of a user, it will stay securely in place around the waist of the user while the user is standing up and walking around, preferably without any support from the hands of the user.

In the support structures of the fifth aspect of the invention, the width, height and length of the front and rear members are such that when the front and rear members are fastened together, they form an enclosure which fits snugly and substantially completely around the waist of the user, which is of sufficient height to provide the desired stability, and which undergoes little or no deformation when the support structure is in use. The enclosure can, for example, have a substantially vertical inner wall surface having a height which is at least 2.5 inch, preferably at least 3.5 inch, e.g. 3.5-6 inch or 3.5-4.5 inch. The front and rear members can for example have at least an inner surface forming part of the enclosure which is resiliently compressible and have a width, such that any movement of the user is accommodated by local and elastic deformation of one or both of the members.

The stability created by the height width and depth of both front and back members and the contact to the person wearing the product, so that the person wearing the product can stand up and walk around, and unassisted by the persons hands the structure will not fall or move in any substantial way. The enclosure created by the inside of the front member and the depth height and width of the back member and how the back members arms wrap around the front member creating a substantially secure enclosure. Substantially secure means that a person wearing the structure can stand up and walk around, and the structure will not move, fall or shift in any substantial way. And the person wearing the product will not need to use their hands to support the structure while walking around.

Preferably, the front member comprises a cover which at least partially, and preferably substantially completely, covers a front member core component which has substantial firmness, and optionally is at least partly composed of a resiliently compressible material, e.g. a polymeric foam, or which is inflated; this cover is hereinafter referred to as the "front cover". In one embodiment, at least those parts of the front cover which are likely to be contacted by a baby when the support structure is in use are composed of a soft cloth, in which case, preferably at least part, and particularly all, of the front cover can be removed, washed (or otherwise cleaned) and then refitted to the front member core component. For this purpose, the front cover can comprise one or more closure members, e.g. one or more zippers and/or one or more Velcro fittings and/or one or more press studs. The front cover can optionally be fitted with one or more pockets to carry feeding bottles, toys, etc. Alternatively, the cover can be made of a material which is attached to the core component, and which can be wiped clean while it is in place.

Similarly, the rear member, preferably comprises a cover which at least partially, and preferably substantially completely, covers a rear member core component which has substantial firmness, and is, for example, at least partly composed of a resiliently compressible material, e.g. a polymeric foam, or which is inflated; this cover is hereinafter referred to as the "rear cover". In one embodiment, at least those parts of the rear cover which are likely to be contacted by a baby when the support structure is in use are composed of a soft cloth, in which case, preferably at least part, and particularly all, of the rear cover can be removed, washed (or otherwise cleaned) and then refitted to the rear member core component. For this purpose, the rear cover can comprise one or more closure members, e.g. one or more zippers and/or one or more Velcro fittings and/or one or more press studs. The rear cover can optionally be fitted with one or more pockets to carry feeding bottles, toys, etc. Alternatively, the cover can be made of a material which is attached to the core component, and which can be wiped clean while it is in place.

In a further aspect, this invention provides a method of using a support structure is according to the first aspect of the invention, in which a user secures the front and rear members around his or her waist, the method being particularly but not exclusively, useful for the purpose of nursing one or more babies placed upon the top surface of the front member. Preferably, the support structure is constructed and used so that it will stay securely in place around the waist of the user while the user is standing up and walking around.

The invention also includes the individual items of the support structures described above, including the front member, the rear member, the front member core component, the rear member core component, the removable front cover and the removable rear cover, which are novel and inventive in their own right; and kits of parts comprising two or more of those individual components; and other novel components useful in this invention.

BRIEF DESCRIPTION OF THE DRAWINGS

The invention is illustrated in the accompanying drawings, which are diagrammatic sketches and are not to scale, and in which FIG. 2*a* is a cross-section on line II-II of. FIG. 1, FIGS. 2*b*-2*o* are alternative cross-sections for the front member.

DETAILED DESCRIPTION OF THE INVENTION

Figure 1:
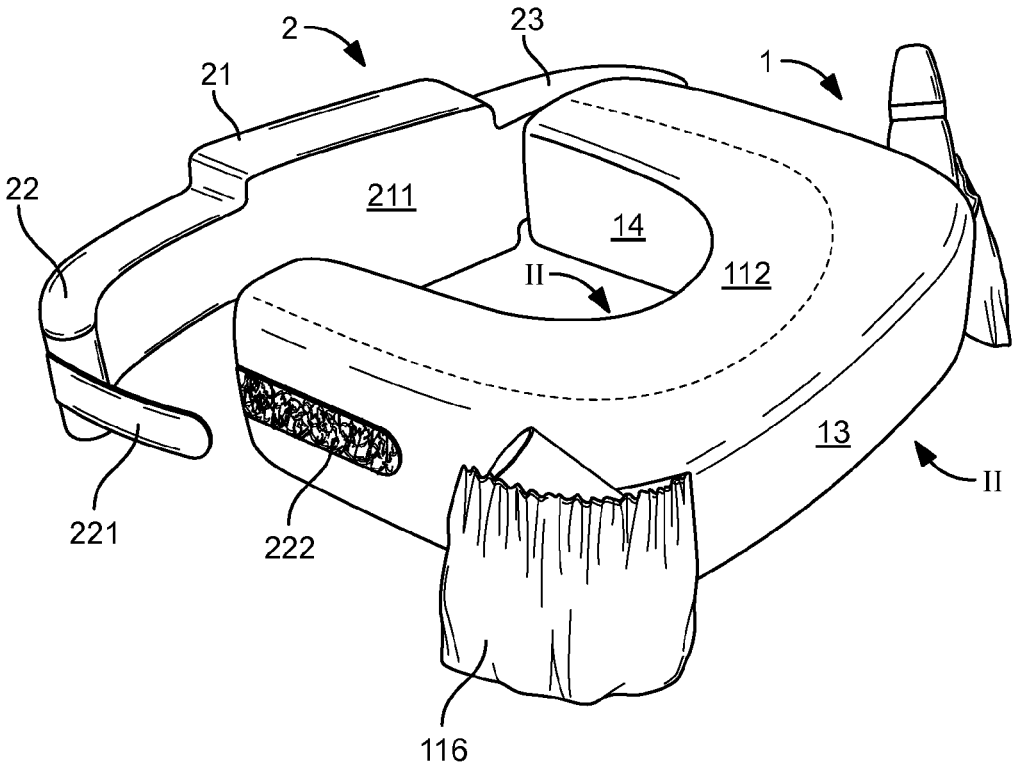
FIG. 1 is a perspective view of the novel support structure of the invention.

In the Summary of the Invention above, the Detailed Description of the Invention, the Examples, and the claims below, and in the accompanying drawings, reference is made to particular features of the invention, including for example components, ingredients, devices, apparatus, systems, and steps. It is to be understood that the disclosure of the invention in this specification includes all possible combinations of such particular features. For example, where a particular feature is disclosed in the context of a particular mode, aspect, embodiment, Figure or claim, that feature can also be used, to the extent possible, in the context of any other particular mode, aspect, embodiment, Figure or claim, and in the invention generally. The invention disclosed and claimed herein includes embodiments not specifically described herein and can for example make use of features which are not specifically described herein but which provide functions which are the same, equivalent or similar to, features specifically disclosed herein.

The term "comprises" and grammatical equivalents thereof are used herein to mean that other features are optionally present. For example, a device "comprising" (or "which comprises") components A, B and C can contain only components A, B and C, or can contain not only components A, B and C but also one or more other components. Where reference is made herein to a method comprising two or more defined steps, then, unless the context requires otherwise, the defined steps can be carried out in any order or simultaneously, and the method can include one or more other steps which are carried out before any of the defined steps, between two of the defined steps, or after all the defined steps. The term "at least" followed by a number is used herein to denote the start of a range beginning with that number (which may be a range having an upper limit or no upper limit, depending on the variable being defined). For example "at least 1" means 1 or more than 1. When, in this specification, a range is given as "(a first number) to (a second number)" or "(a first number)-(a second number)", this means a range whose lower limit is the first number and whose upper limit is the second number. For example, "0.5-3" means a range whose lower limit is 0.5, and whose upper limit is 3. The numbers given herein should be construed with the latitude appropriate to their context and expression. The terms "plural" and "plurality" are used herein to mean two or more. When reference is made herein to "a", "an", "one" or "the" feature, it is to be understood that, unless the context requires otherwise, there can be one or more than one such feature.

Where reference is made herein to two or more components (or parts or portions etc.), it is to be understood that the components can be, unless the context requires otherwise, separate from each other or integral parts of a single structure or a single component acting as the two or more specified components.

Where reference is made herein to components of the support structure which have a width, or a depth, or a height; or which extend downwards, upwards, or sideways; or which are below or above or in front of or behind or on top of a component, it is to be understood that those references assume that the support structure is in an orientation in which the front member is generally horizontal.

In some embodiments of the invention, the front and rear members are joined together when the support structure is not in use. They can for example be joined together, permanently or separably, by one or more fasteners attached to one or both of front and rear covers covering the front and rear members. The invention also includes the possibility that a first arm of the rear member is flexibly but permanently joined to one end of the front member, e.g. to one of the end wall surfaces and/or to a part of the outer wall surface adjacent to one of the end wall surfaces, so that the rear is member can first be positioned so that a user's waist can be placed within enclosure, and then can be swung around to form the enclosure which comprises the central member and the inner wall surface of the front member. This possibility includes the possibility that the flexible joint between the rear member and the front member is formed partly or exclusively by a flexible joint between the front and rear covers.

In some embodiments of the invention, separable front and rear members are joined together through one or more fasteners attached to one or both of front and rear covers. Preferably, the fastener, or if there is more than one fastener, at least one of those fasteners, is adjustable and can be easily secured and released by a user. For example, the fastener can make use of Velcro pads, straps and buckles, etc. The fasteners can be identical or different.

In one example of this embodiment, fasteners are provided to join together (1) those parts of the rear cover which cover the exterior parts of the first and second arms and (2) those parts of the front cover which cover the outer wall surface at the ends of the arms of the front member. Preferably, at least one of the fasteners, when it is fastening the front and rear covers, provides a flexible fastening between (1) that part of the rear cover which covers one of the arms of the rear member and (2) that part of the front cover which covers the end wall surface and/or a part of the outer wall surface adjacent to one of the end wall surfaces. The use of such a flexible fastener makes it possible, while that fastener is still secured, for the rear member to be positioned so that the first member can be placed around a user's waist, and thereafter for the rear member to be swung into place so that the free arm of the rear member can be secured in place, thus forming the enclosure.

In another example of this embodiment, the fastener is a flexible member which is secured to the front cover and which, when the enclosure is to be formed, holds the rear member in place. Exemplary implementations of this example include (1) a flexible fastener which has one end secured to the front cover adjacent to the outer wall surface is of the front member near one of the ends of the front member, and which, in use, is passed around the rear member and then secured to the front cover adjacent to the outer wall surface of the front member near the other end of the front member, (2) a flexible fastener having (a) a central portion which is secured to the front cover and (b) arms which extend from the central portion and which, in use, are passed around the rear member, and secured to each other behind the rear member, and (3) two flexible fasteners, each of which has one end secured to the front cover and which, in use, can be secured to each other behind the rear member or respectively secured to the rear cover.

In another example of this embodiment, the fastener is a flexible member which is secured to the rear cover and which, when the enclosure is to be formed, holds the rear member in place. Exemplary implementations of this example include (1) a flexible fastener which has one end secured to the rear cover adjacent to one of the first and second arms and which, in use, is passed around the front member and then secured to the rear cover adjacent to the other of the first and second arms, (2) a flexible fastener having a central portion which is secured to the rear cover and arms which extend from the central portion and which, in use, are passed around the front member, and secured to each other in front of the front member; and (3) two flexible fasteners, each of which has one end secured to one of the arms of the rear member, and which, in use, can be secured to each other in front of the front member or respectively secured to the front cover.

In preferred embodiments of the invention, at least one of the top surface, the bottom surface and the inner wall surface of the front member is shaped so that, when the front and rear members form the enclosure and the enclosure fits around the waist of a user who is sitting down with the lower surface of the front member resting on the user's knees, the top surface of the front member comprises (i) a first area which extends across the front of the user and which will is horizontal or is inclined downwards at a first angle to the horizontal and (ii) a second area which extends across the front of the user and is inclined downwards at a second angle to the horizontal, the second angle being greater than the first angle if the first area is not horizontal, and the second area lying between the first area and the user. It has been found that this feature makes it significantly easier to make use of the support structure, e.g. to maintain a baby, or a pair of babies, in a desired stable position, while still providing desired support for the arms of the user of the support structure.

In some embodiments, the first and second areas are at least in part, and preferably completely, produced by shaping the upper surface of the first member core component. In that case, the areas can be observed when the support structure is not in use (provided that the first cover, if present, is not too loose). Alternatively or additionally, one or both of the two areas are at least in part produced by the interaction between the front member and the thighs and/or knees of a person who is sitting down with the support structure around his or her waist. Alternatively or additionally, the two areas are at least in part produced by the interaction between the baby or babies (or other weight) placed upon the top surface, this interaction being in addition to the local deformation of the upper surface by the baby or babies (or other weight). In these cases, the two areas can be the result of shaping the lower surface of the front member (which can cause the top surface to be tilted towards the user), and/or by shaping the inner wall surface (for example by means of one or more indentations) so that, in use, the height of the inner wall surface decreases. The first and second areas can alternatively or additionally result from the presence of voids which lie within the front member and which change shape when the support structure is in use. Such voids can, for example, be produced by joining together the faces of two generally planar members, at least one of which has voids in the face to be joined.

The two areas can be present over substantially the whole of the top surface of the first member. Alternatively, the two areas can be present over only part of the top surface of the first member, for example (1) the two areas can be present over at least 40% or at least 60%, e.g. at least 80%, of the length of the front member, but not be present at the ends of the front member; or (2) can be present over at least part of each of the legs of the front member, but not be present at the front of the front member, over a length which is, for example, 10-30% of the length of the front member.

In some embodiments of the invention, there is an upstanding ridge on the upper surface adjacent to or near the inner wall surface and/or an upstanding ridge on the upper surface adjacent to or near the outer wall surface. It has been found that the presence of such a ridge is useful in preventing unwanted movement of a baby (or an inanimate article). The presence of one or both such ridges can be in addition to the presence of two areas as described above, but the invention includes (1) support structures in which the upper surface has one or both such ridges but does not have either of the two areas described above, and (2) support structures in which the upper surface has one or both such ridges and only a second area as described above (i.e. which does not have, in use, a substantially horizontal area.

Optional features of the invention include the following.

1. The front member comprises
   (a) a front section which has substantial width and substantial thickness,
   (b) two side sections which extend from either end of the front section, and generally at right angles to the front section, and which have substantial width, and substantial thickness.
2. The upper surface comprises said first and second areas, the first area is substantially horizontal, and each of the first and second areas extends across substantially the whole of the front section.
3. The front member comprises (i) a front member core component at least part of which has substantial firmness, e.g. is composed of a resiliently compressible material, and which comprises a front section core component and side section core components, the front section core component and the side section core components being joined together, and (ii) a front cover over the front member core component.
4. The rear member comprises a rear member core component at least part of which has substantial firmness, e.g. is composed of a resiliently compressible material, and (ii) a rear cover over the rear member core component.
5. The front member core component and the rear member core component are separate from each other, and the front and rear members are joined together by at least one flexible fastener which connects the front and rear covers.
6. The upper surface of the front member comprises said first and second areas, and the first and second areas are present when the support structure is not in use.
7. The upper surface of the front member, when the support structure is in use, comprises said first and second areas, and the front member is shaped such that, when the enclosure of the support structure surrounds the waist of a user who is sitting with the support structure on the user's knees and/or thighs, the first and second areas are at least in part produced, or are modified, by the interaction between the support structure and the user's knees and/or thighs.
8. The front member core component
   (a) has substantial width and substantial thickness,
   (b) comprises
      an upper surface,
      a lower surface,
      an outer wall surface which extends from the upper surface to the lower surface and which provides an outer surface of the front member core component,
      an inner wall surface which extends from the upper surface to the lower surface and which provides an inner surface of the front member core component, and two end wall surfaces, each of which extends from the upper surface to the lower surface at the ends of the front member core component; and provide outer surfaces at the ends of the front member core component.

9. The rear member comprises.

(a) a central member which (i) has substantial width and substantial thickness, (ii) when the rear member is in the second position, extends between the end wall surfaces of the front member core component, and (iii) when the rear member is in the second position, has an inner surface which provides part of the enclosure and which has substantial firmness, (b) first and second arms which extend from either side of the central member, each of the first and second arms, when the rear member is in the second position, extending around respective end wall surfaces of the front member core component, and optionally around the adjacent outer wall surfaces.

The front member can have one or more of the following optional characteristics, i.e. a single one of the listed characteristics or a combination of two or more of the listed characteristics where such combination is possible.

(A1) It is monolithic and (i) is composed of a polymeric foam, for example, an open cell foam, or (ii) is an inflated component.

(A2) it comprises an upper component which provides the upper surface and which is composed of a first material, e.g. a polymeric foam, and a lower component which provides the lower surface and which is, for example, composed of the second material, e.g. a polymeric foam.

(A3) It has a width of 3-20 inch, for example 4-12 inch, e.g. 6-9 inch, measured from the inner wall surface to the outer wall surface, over at least 50%, e.g. at least 70%, or at least 80% of the top surface. The width can be uniform, but preferably the front member comprises a central portion and two side portions, the width of at least part of the central portion being greater than the width of the side portions. For example, at least part of the front portion has a width of 3-20 inch, e.g. 4-12 inch, and at least part of the side portions has a width of 4-10 inch. In one embodiment, the front portion has a first width at the bottom of the U, e.g. a width of 6-9 inch, for example 7-8 inch, and is broadens out to a second width as it progresses towards the arms of the U, e.g. to a width of 8-11 inch, for example 9.5-10.5 inch, before the width of the front member decreases to the width of the side portions. Where the width of the front member changes, the change is preferably continuous, but it can be discontinuous. The width of the front member can be the same throughout its depth, or can change continuously or discontinuously.

(A4) The first area of the upper surface is substantially horizontal.

(A5) The first area of the upper surface extends around at least 80%, preferably at least 90%, e.g. substantially 100%, of the length of the front member.

(A6) The first area of the upper surface extends to the outer wall surface (A7) The second area of the upper surface is inclined to the first area at an angle of 3-45°, for example 3-25°, e.g. 5-15°.

(A8) The second area of the upper surface extends to the inner wall surface.

(A9) The first area of the upper surface extends around at least 80%, preferably at least 90%, e.g. substantially 100%, of the length of the front member.

(A10) The upper surface includes a third area which lies between the inner wall surface and the second area, and which lies in a plane substantially parallel to the first area.

Figure 2A:
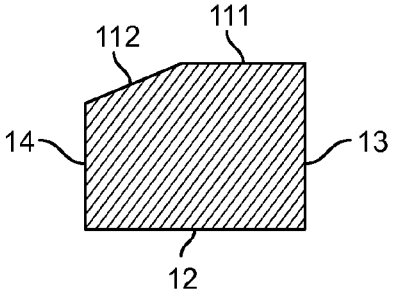
Figure 2F:
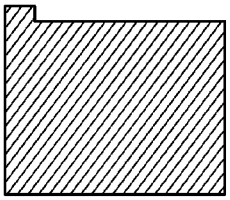
Figure 2B:
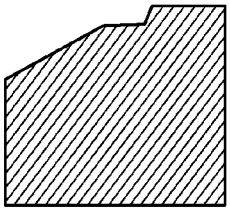
Figure 2G:
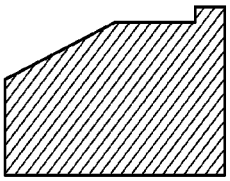
Figure 2C:
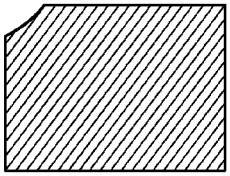
Figure 2H:
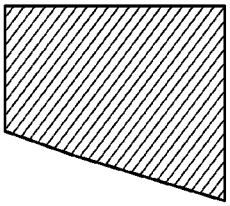
Figure 2D:
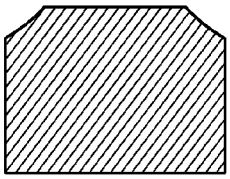
Figure 2I:
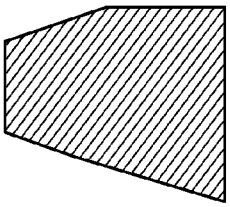
Figure 2E:
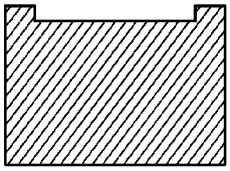
Figure 2J:
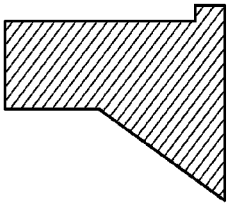
Figure 2K:
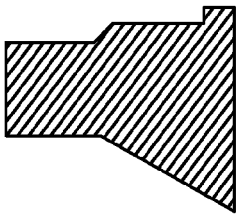
Figure 2L:
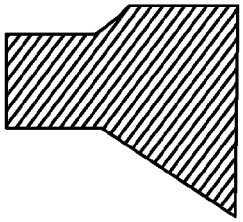
Figure 2M:
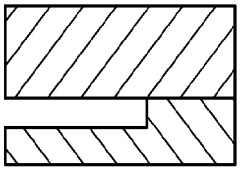
Figure 2N:
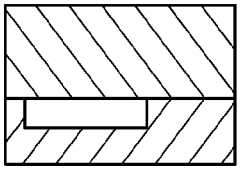
Figure 2O:
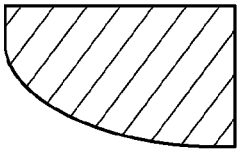

(A11) The upper surface has a profile substantially as shown in one of FIGS. 2*a*-2*o*.

(A12) The lower surface of the front member is substantially planar and substantially horizontal.

(A13), The lower surface of the front member lies in a plane which is inclined to the horizontal at an angle of 3-45°, e.g. 5-25°, for example 3-15°.

(A14) The lower surface of the front member contains a pair of depressions to accommodate a user's thighs and/or knees.

(A15) The front member has a depth of 4-7 inch, e.g. 5-6 inch.

The rear member can have one or more of the following optional characteristics, i.e. a single one of the listed characteristics or a combination of two or more of the listed characteristics where such combination is possible.

(B1) The central member has an inner surface which, in use, forms part of the enclosure and which is at least partly composed of a material having substantial firmness, e.g. a resiliently compressible material.

(B2) The central member, in use, extends inwards towards the enclosure so that it provides lumbar support for a user of the support structure. For example, the inner surface of the central member can be substantially aligned with the inner wall surface of the front member, or can extend into the enclosure, for example by a distance of up to 2 inch.

(B3) The central member, in use, extends upwards above the top surface of the front member, for example by a distance (height) of 1-10 inch, for example 1-6 inch, e.g. 1-3 inch.

(B4) The arms of the rear member have a depth of 4-7 inch, e.g. 5-6 inch, for example a depth substantially the same as the depth of the front member.

(B5) The central member has a horizontal length of 9-15 inch, for example 11-13 inch.

The front member and the rear member can have any shape, which results in a suitable enclosure when the front and rear members are secured together. The enclosure has a curved section at the front and sides of the enclosure and preferably includes a substantially straight section adjacent to the back of the user. In some embodiments, the front member provides at least part of curved section at the front of the enclosure and the rear, and optionally part of the curved section member provides a substantially straight section at the back of the enclosure. For example, the front member can be substantially U-shaped, C-shaped, or molar-shaped.

Another alternative is for the front member to have a front section having an outer wall which is substantially straight or which is curved, and an inner wall which is curved, and side sections which extend away from the front section generally at right angles to the front section, and each of which has an outer wall which is substantially straight or curved and an inner wall which is curved.

The Drawings.

Figure 3:
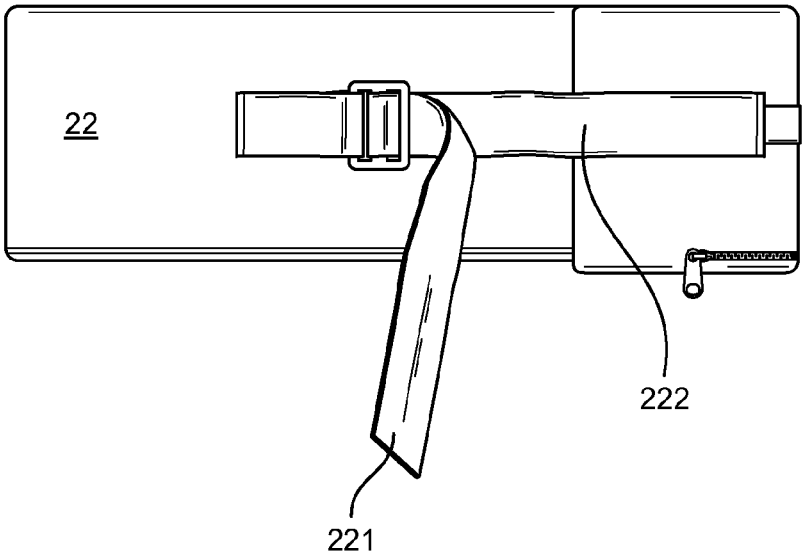
FIG. 3 shows one arrangement for securing the rear member to the front member.
Figure 4:
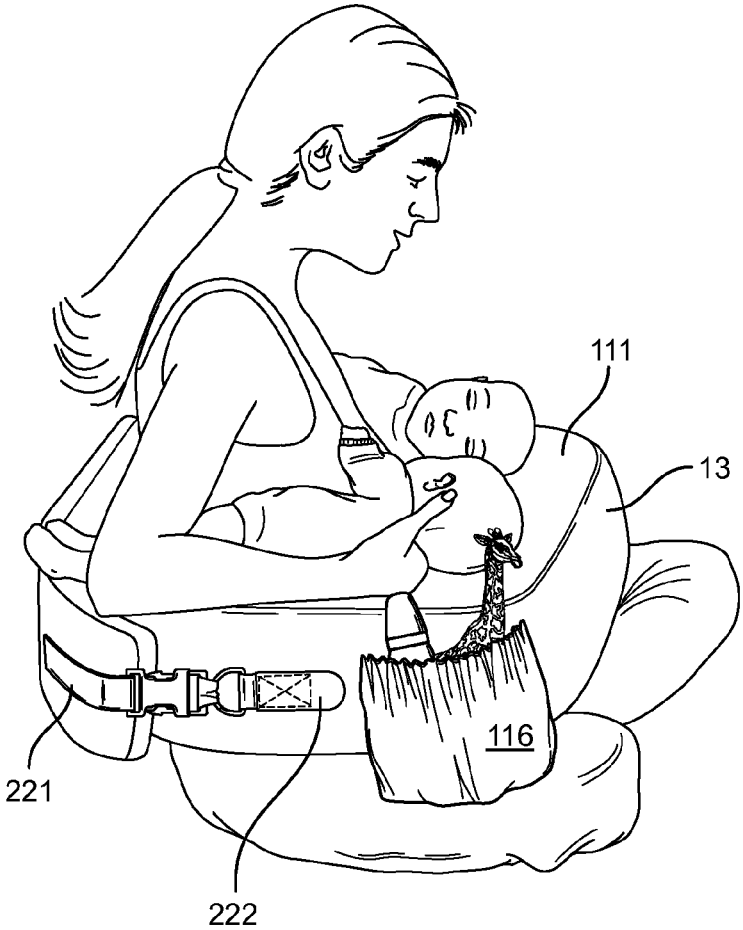
FIGS. 4 and 5 are perspective views of the novel support structure in use.
Figure 5:
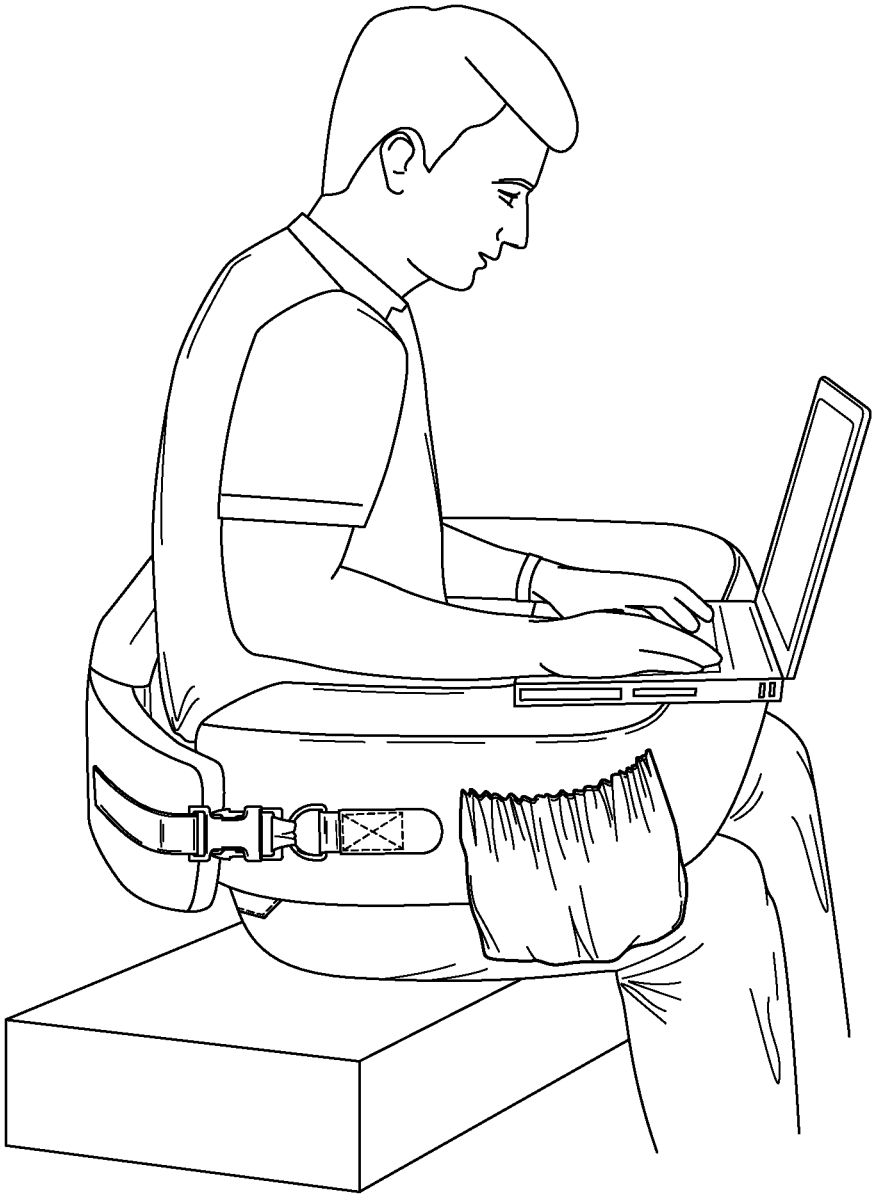

Referring now to the drawings, the Figures show front member 1 and rear member 2. The front member 1 includes outer surface 13, inner surface 14, and top surface 112 which is divided into two areas, delineated by the dotted line, the area, adjacent to the outer surface being horizontal, and the area, adjacent to the inner surface sloping downward. Pouch 116 is attached to the outside of the front member. Rear member 2 comprises central member. 21 having inner surface 211, and arms 22 and 23. FIGS. 1 and 3 show fasteners 221 and 222 attached to the front and rear members (Velcro straps in FIG. 1, and straps and adjustable buckles in FIGS. 3 and 4). FIG. 2*a* shows the cross-section of the front member in FIG. 1, and FIGS. 2*b*-2*o* show other exemplary cross-sections for part or all of the front member FIGS. 2*b*, 2*c*, 2*d*, 2*g*, 2*i*, 2*k* and 2*l* show cross-sections in which the upper surface of the front member has been modified to provide a horizontal area and a sloping area. FIGS. 2*e*, 2*f*, 2*g*, 2*i* and 2*k* show cross-sections having a ridge extending upwards from the top surface of the front member. FIGS. 2*h*, 2*i*, 2*k*, 2*l* and 2*o* show cross-sections in which the bottom surface of the front member has been shaped to produce, when the support structure is in use, a desired slope on the upper surface of the front member. FIG. 2*m* shows a cross-section in which the inner wall of the front member has been modified to produce, when the support structure is in use, a desired slope on the upper surface of the front member. FIG. 2*n* shows a cross-section contains an internal void to produce, when the support structure is in use, a desired slope on the upper surface of the front member.

Figure 6:
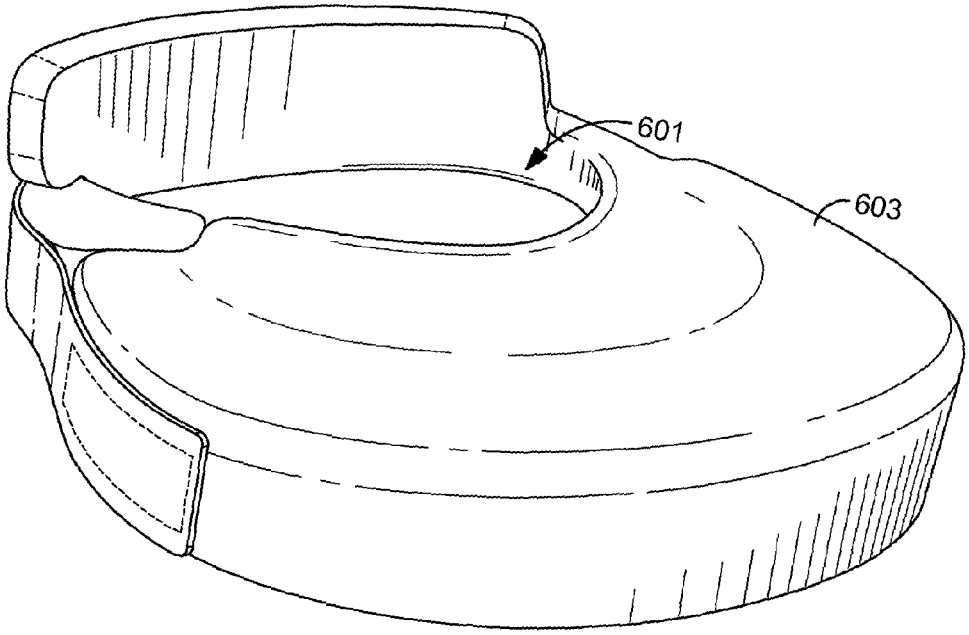
FIG. 6 is a perspective view of an alternative embodiment of the support structure.

FIG. 6 is a perspective view of a support pillow 603 according to the invention illustrating, in a general manner, the movement of the two ends of the support pillow 603 to form a substantially fully enclosed opening 601 through which a user's waist fits. The support pillow 603 is made with a shape so that the ends of the support pillow 603 are proximal to, but usually spaced apart from, each other. In the embodiments shown herein, the side portion opposite the pillow ends is made with a small width relative to the width of the front portion. The support pillow 603 is also made of a flexible material. Thus, the pillow 603 can be cantilevered about the side portion so that the back portion moves with respect to the front portion to enable the ends of the support pillow 603 to be moved into contact with each other. Further, in the embodiment shown in FIG. 6, the pillow 603 is shaped so that, when the ends are moved against each other, one of the ends slightly overlaps the other end. As a result of the above characteristics, the back and front portions of the pillow 603 can be variably positioned with respect to each other so that the opening in the pillow 603 can vary in size, enabling the pillow 603 to fit snugly around people having a range of waist sizes.

I claim:

1. An apparatus comprising:

a first area having an outer edge, an inner edge, a top face and a bottom face, the top face configured to encourage an object resting on the top face towards the inner edge, the first area having a cavity therein, the cavity located such that a weight on the top face at least partially collapses the cavity and inclines the top face downward towards the inner edge; and a second area, integral with the first area, the second area movable between a connected position and a disconnected position wherein in the disconnected position the first area and the second area create a space through which a torso of the user can pass, and wherein in the connected position the first area and the second area substantially enclose the torso of the user.

2. The support structure of claim 1, further comprising:

the bottom face of the first area shaped so that, when the first area and the second area form an enclosure, with the user sitting down with the bottom face of the first area resting on thighs or knees of the user, the top face inclines downwards towards the inner edge.

3. The support structure of claim 1, further comprising:

a fastener configured to fasten the second area to the first area in the connected position.

4. The support structure of claim 1, wherein the first area and the second portion are a unitary piece.

5. The support structure of claim 1, further comprising:

a cover secured to and removable from the first area and the second area.

6. The support structure of claim 1, further comprising:

a cover covering the first area and the second area, the cover having at least one pocket.

7. A support structure that can fit around a torso of a user, comprising:

a continuous body including a compressible, resilient material; and the continuous body having a front portion and a rear portion, the front portion and the rear portion separable at a location to provide a gap through which the torso of the user can be inserted, the front portion having an upper surface that is substantially parallel to the ground when the support structure is around the torso of the user, the front portion having a void therewithin.

8. The support structure of claim 7, further comprising:

a fastener configured to close the gap and fasten the rear portion and the front portion together at the location.

9. The support structure of claim 7, further comprising a cover and a fastener.

10. The support structure of claim 7, wherein the front portion is thinner closer to the waist of the user and thicker further from the waist of the user.

11. A support structure that can fit around a torso of a user, comprising:

a unitary body including a compressible, resilient material; and the unitary body having a front portion and a rear portion, the front portion and the rear portion separable at a location to provide a gap through which the torso of the user can be inserted, the front portion having an upper surface that has contour, the front portion having a void within the compressible, resilient material, the void positioned so that a partial collapsing of the void results in the upper surface sloping downward towards the waist of the user.

12. The support structure of claim 11, wherein the upper surface slopes downward towards the waist of the user.

13. The support structure of claim 11, wherein a first portion of the upper surface includes a ridge extending upwards, and a second portion of the upper surface is lower than the ridge.

14. The support structure of claim 11, further comprising:

a fastener configured to secure the support structure around the waist of the user.

15. The support structure of claim 11, further comprising:

a cover fitted to and removable from the unitary body, the cover having a closure member.

16. A support structure that can fit around a torso of a user, the support structure comprising:

a unitary body including a compressible, resilient material; and the unitary body having a front portion and a rear portion, the front portion and the rear portion separable at a location to provide a gap through which the torso of the user can be inserted, the front portion having an upper surface that has contour, the front portion having a lower surface with at least one depression dimensioned to fit thighs or knees of the user.

17. The support structure of claim 16, wherein the upper surface slopes downward towards the waist of the user.

18. The support structure of claim 16, wherein a first portion of the upper surface includes a ridge extending upwards, and a second portion of the upper surface is lower than the ridge.

19. The support structure of claim 16, further comprising:

a fastener configured to secure the support structure around the waist of the user.

20. The support structure of claim 16, further comprising:

the front portion having a void within the compressible, resilient material, the void positioned so that a partial collapsing of the void results in the upper surface sloping downward towards the waist of the user.

21. The support structure of claim 16, further comprising: a cover fitted to and removable from the unitary body, the cover having a closure member.

* * * * *